US005115649A

United States Patent [19]

Amber

[11] Patent Number: 5,115,649

[45] Date of Patent: May 26, 1992

[54] INVISIBLE SETTING FOR ROUND DIAMONDS

[75] Inventor: Betzalel Amber, Los Angeles, Calif.

[73] Assignee: Ambar Diamonds, Inc., Los Angeles, Calif.

[21] Appl. No.: 712,501

[22] Filed: Jun. 10, 1991

[51] Int. Cl.[5] ..... A44C 17/02

[52] U.S. Cl. ..... 63/26; 63/32; 63/29.1

[58] Field of Search ..... 63/26, 32, 29.1, 29.2, 63/30, 31

[56] References Cited

U.S. PATENT DOCUMENTS

| | | | |
|---|---|---|---|
| 1,207,773 | 12/1916 | Larson | 63/29.1 |
| 2,141,363 | 12/1938 | Rigollet | 63/26 |
| 3,933,011 | 1/1976 | DiGilio | 63/29.1 |
| 4,800,738 | 1/1989 | Bunz | 63/26 |
| 4,813,246 | 3/1929 | Richards | 63/26 |
| 4,982,581 | 1/1991 | Furuyama | 63/29.1 |

FOREIGN PATENT DOCUMENTS

| | | | |
|---|---|---|---|
| 764966 | 12/1933 | France | 63/26 |
| 2420314 | 11/1979 | France | 63/29.1 |
| 2570259 | 3/1986 | France | 63/26 |
| 2598297 | 11/1987 | France | 63/29.1 |

*Primary Examiner*—Renee S. Luebke
*Assistant Examiner*—F. Saether
*Attorney, Agent, or Firm*—Levisohn, Lerner & Berger

[57] ABSTRACT

A method and apparatus for invisibly setting round diamonds is disclosed. The diamonds are provided with grooves cut in the pavilion below the girdle of the diamond, and a round barrel is provided which has ridges projecting inwardly from the inner wall of the barrel. The diamond is rotated into the barrel to interlock the ridges within the grooves formed in the diamond to hold the barrel and diamond securely together. The barrel is formed of deformable metal which itself is hammered thereby further preventing relative rotation between the diamond and barrel and ensuring the diamond is securely set within the barrel.

12 Claims, 2 Drawing Sheets

FIG. 1
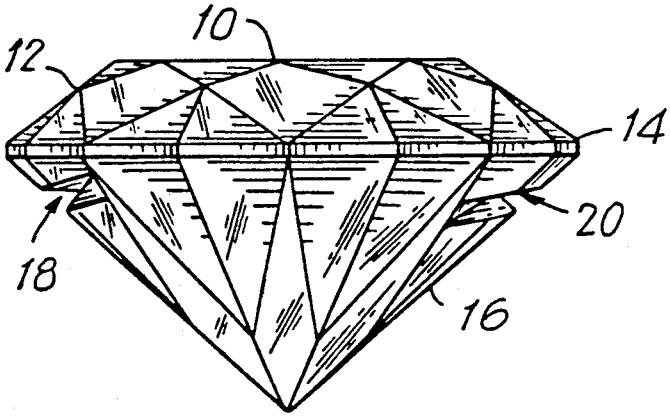
FIG. 2
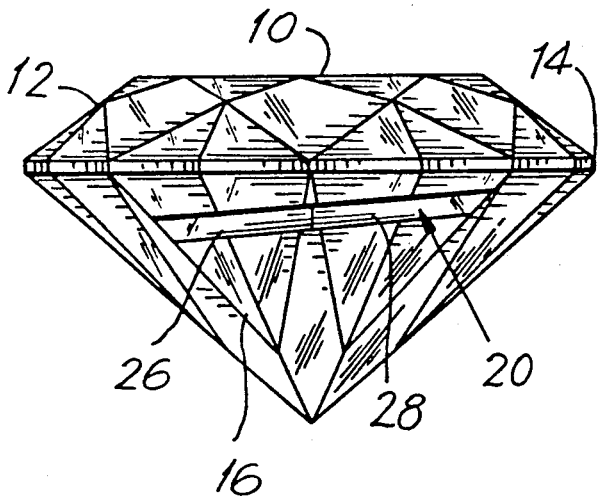
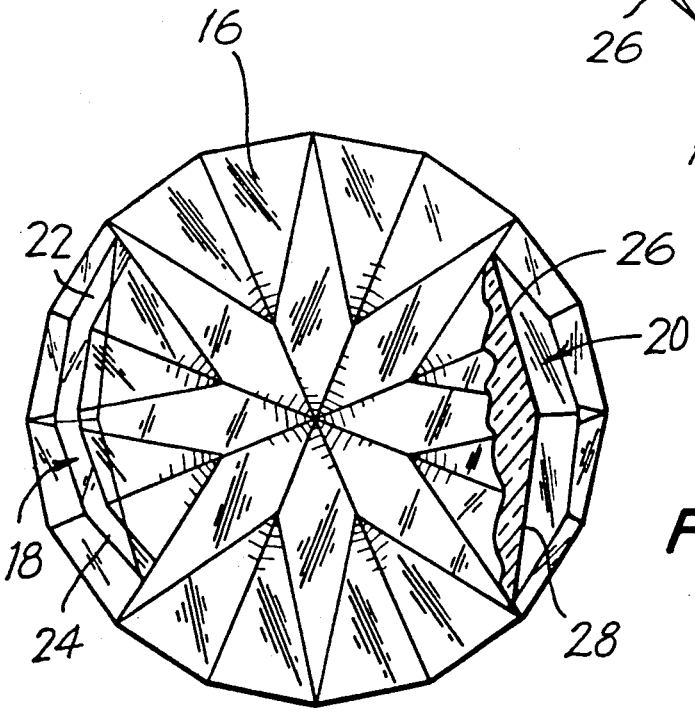
FIG. 3

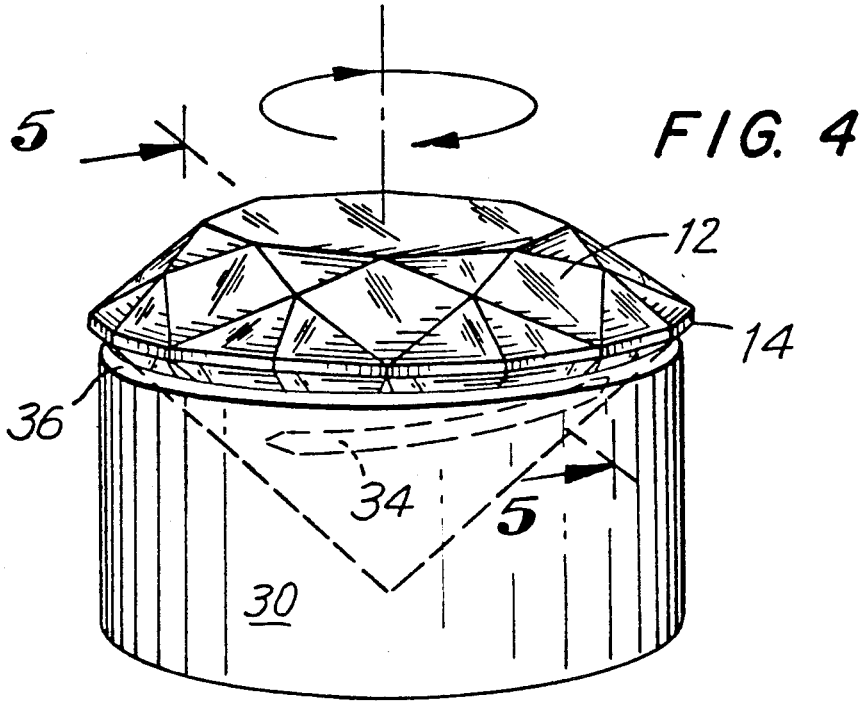
FIG. 4
FIG. 5
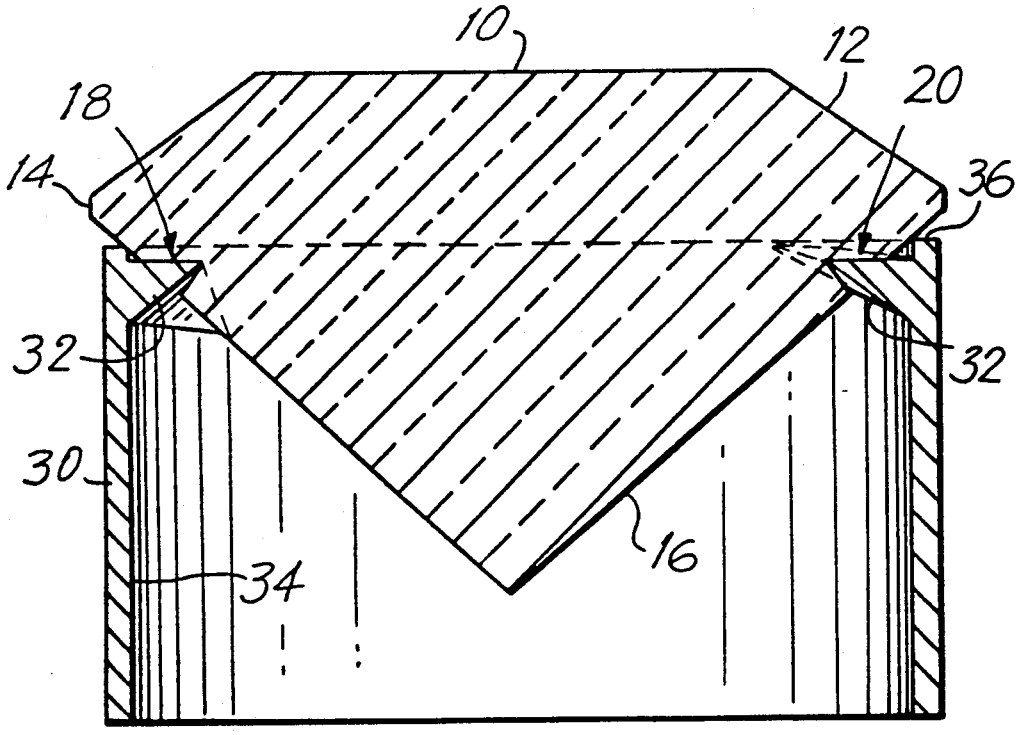

INVISIBLE SETTING FOR ROUND DIAMONDS

BACKGROUND OF THE INVENTION

This invention relates to a method and apparatus for setting round diamonds in high quality jewelry in which the setting is "invisible".

Prior art settings for round diamonds have generally included a "box-setting" identified in U.S. Pat. No. 795,109 dated Jul. 18, 1905 to George W. Dover. That box-setting is illustrative of the conventional setting techniques in which the metal holding the round diamond is visible which interferes with the overall diamond presentation of the set jewelry.

U.S. Pat. No. 4,738,240, entitled Process for Cutting a Diamond to Provide an Invisible Mounting, describes a process for cutting a diamond to provide cuts below the girdle. The diamonds illustrated in that patent are square, and although there are cuts provided below the girdle for purposes of providing an invisible mounting, there is no showing or suggestion of an apparatus and method for cutting and setting of round diamond as with the barrel in accordance with the principles and teachings of the present application.

An object of this invention is to provide a method and apparatus for "invisibly" setting round diamonds so as to enhance the overall visual and aesthetic appeal of the jewelry setting.

Another object of this invention is to provide such a method and apparatus which is easy to practice, which minimizes damage to the stones and which presents improved visual aesthetic effects for the set jewelry.

Yet another object of this invention is to provide such a method and apparatus in which the set diamond is securely held and cannot accidentally be dislodged to fall out from the setting.

Other objects, advantages and features of this invention will become more apparent from the following description.

SUMMARY OF THE INVENTION

In accordance with the principles of this invention, the above objects are accomplished by providing a round barrel of a size slightly smaller than the outer diameter of the round diamond, providing grooves in the pavilion portion just below the girdle of the diamond, the barrel having ridges projecting inwardly from the inner wall thereof, and means to secure the diamond within the barrel, either by rotating the diamond so that the ridges slide within the grooves, or press fitting the diamond into the barrel so that the ridges snap fit into the grooves so that the diamond is securely held in the barrel. The barrel is made of a deformable metal so that slight hammering can be imparted to the metal barrel to deform it and thus further prevent rotation or movement of the diamond with respect to the barrel thereby securing the setting of the stone within the barrel.

The invisible setting is achieved because the barrel is set beneath the girdle of the diamond, thereby rendering it "invisible" or unobserved to the normal wearer. Where diamonds are set in a ring, the barrels would be soldered edge to edge or could be secured together in any suitable fashion. Because the diameter of the diamond is larger than the diameter of the barrel, the barrel remains hidden from view, and the diamonds are "invisibly" set thus providing enhanced visual appearance to the stone.

The grooves are cut in the diamonds at a slight angle with respect to the horizontal to match the angle of the ridges formed in the barrel such as to ensure the secure fitting between the diamond and barrel when the diamond is rotated to secure the ridges within the grooves of the diamond. The grooves are formed by a grinding wheel which simultaneously forms the grooves and also polishes them so as to eliminate possible gray or shadow effects which could form in the diamond. This further enhances the overall aesthetic appeal of the diamond in that the cut grooves provide a type of faceting thereby enhancing the brilliance of the diamond.

BRIEF DESCRIPTION OF THE DRAWING

FIG. 1 is a side view of a round diamond showing grooves cut therein;

FIG. 2 is a front view of the diamond showing a groove cut within the diamond;

FIG. 3 is a bottom view of the diamond showing grooves cut within the diamond;

FIG. 4 is a perspective view illustrating the diamond being rotated with respect to the barrel to have the ridge of the barrel slip into the groove of the diamond.

FIG. 5 is a sectional view along lines 5—5 of FIG. 4.

DETAILED DESCRIPTION

FIG. 1 illustrates a round diamond in which there is the table or top portion 10, facets 12 of a girdle portion 14, the girdle portion terminating in the outer circumference of the round diamond, with a pavilion portion 16 formed below girdle 14. Grooves 18 and 20 are formed in the pavilion just below the girdle of the diamond, and preferably the grooves will extend on each side at least 70% of the diameter of the diamond as illustrated in FIG. 2.

The grooves 18 and 20 may be formed as a pair of grooves 22 and 24 and 26 and 28, respectively with grooves 22 and 26 and 24 and 28 being located opposite to each other, thereby providing four grooves formed at substantially the same level in the pavilion 16 of the diamond.

FIGS. 3 through 5 illustrate the barrel 30 of this invention as well as the method of setting the diamonds. The barrel 30 is comprised of a round, cylindrical structure, preferably of deformable metal of a size slightly smaller than the girdle circumference 14 of the diamond. Ridges 32 are formed opposite to each other and inwardly depending from the inner wall 34 of the barrel. The ridges are formed of a height so that the top 34 of the barrel will rest just below the circumferential girdle 14 of the diamond, and the ridges 32 will be able to slide within the grooves formed in the diamond as the diamond is rotated into the barrel as illustrated in FIG. 5. In order to enhance this sliding and interlocking feature, the grooves are slightly angled with respect to the horizontal as are the ridges formed in the barrels. In this fashion, the diamond is rotated, and the ridges slide into the grooves thereby locking the diamond in place. The metalbarrel is deformed, by hammering to further prevent the diamond from rotating out of the barrel.

The diamond could be set within the metal by merely press fitting the diamond into the barrel so that the ridges could snap fit into the grooves of the diamond, although the above method and apparatus for invisibly setting is preferable as minimizing damage to the diamond.

As can be seen, the barrel is set below the circumferential girdle of the diamond and is invisible to the normal eye. As worn, diamonds set with this method and apparatus will be more brilliantly set than the prior art, since no metal holding the diamonds will be seen by the wearer. Therefore, an extraordinary brilliance will attach to diamonds set by this method.

In order to enhance the brilliance of the set diamonds, the grooves are simultaneously polished as they are cut to further provide more reflecting surfaces for the diamonds grooved and cut in accordance with the principles of this invention.

This invention has been described with reference to a preferred embodiment, and the scope and protection of this invention is as set forth in the appended claims.

I claim:

1. Apparatus for setting round diamonds comprising:

a round diamond having a girdle forming its outer diameter and a pavilion portion below the girdle, with grooves formed on the pavilion portion of the diamond;

a barrel of a size smaller than the outer diameter of the diamond;

said barrel comprising an inner wall;

ridge means formed on said inner wall projecting inwardly from said wall;

said diamond placed in said barrel with said diamond held in place by said ridge means engaged in said grooves of said diamond;

wherein said grooves are located around said diamond in said pavilion portion at an angle with respect to a top of said diamond, said ridge means comprising ridges spaced around the inner wall of said barrel, wherein said diamond is rotated to slide said ridges into said grooves.

2. Apparatus as set forth in claim 1, wherein said barrel is round.

3. Apparatus as set forth in claim 2, wherein said barrel is made of metal which is deformable.

4. Apparatus as set forth in claim 1, wherein said ridges are formed at an angle with respect to the top of said barrel, said angles of said grooves and ridges being complementary to permit the grooves to slide within said ridges.

5. Apparatus as set forth in claim 4, wherein said barrel is made of metal which is deformable.

6. Apparatus as set forth in claim 4, wherein the grooves are formed just below the girdle of the diamond.

7. Apparatus as set forth in claim 1, wherein said barrel is made of metal which is deformable.

8. Apparatus as set forth in claim 1, wherein the grooves formed on the pavilion entered partially circumferentially around the diamond.

9. Apparatus as set forth in claim 8, wherein the grooves are formed as a pair of grooves formed oppositely to each other.

10. Apparatus as set forth in claim 8, wherein the cumulative circumferential angle of the grooves is equal to at least 120°.

11. Apparatus as set forth in claim 10, wherein the cumulative angle of the grooves is equal to at least 140°.

12. Apparatus as set forth in claim 1, wherein the grooves are polished as they are cut.

* * * * *